US006151823A

United States Patent [19]

Gregory-Gillman

[11] Patent Number: 6,151,823

[45] Date of Patent: Nov. 28, 2000

[54] TRANSPARENT PROTECTIVE COLLECTIBLE TAG HOLDER

[76] Inventor: Anita Gregory-Gillman, 266 Fruitwood La., Central Islip, N.Y. 11722

[21] Appl. No.: 09/187,785

[22] Filed: Nov. 7, 1998

Related U.S. Application Data

[63] Continuation-in-part of application No. 29/075,575, Aug. 21, 1997, Pat. No. Des. 407,444.

[51] Int. Cl.[7] ..... G09F 3/20

[52] U.S. Cl. ..... 40/661; 40/771; 383/35; 383/907

[58] Field of Search ..... 40/654.01, 661, 40/661.04, 661.05, 661.08, 771; 383/35, 907; D9/331; D20/22, 23

[56] References Cited

U.S. PATENT DOCUMENTS

| | | | |
|---|---|---|---|
| 179,461 | 7/1876 | Nolin | 383/907 |
| 196,546 | 10/1877 | Spence | 383/907 |
| D. 287,864 | 1/1987 | Perfect | D20/27 |
| D. 346,828 | 5/1994 | Hagen | D20/22 |
| D. 390,275 | 2/1998 | Wolff | D20/22 |
| 839,529 | 12/1906 | Weissbrod | 383/907 |
| 1,246,369 | 11/1917 | Winans | 40/661 |
| 1,479,136 | 1/1924 | Guinzburg | 383/907 |
| 1,479,137 | 1/1924 | Guinzburg | 383/907 |
| 1,600,633 | 9/1926 | Hildebrand | 383/907 |
| 1,626,565 | 4/1927 | Stanton | 40/653 |
| 2,710,037 | 6/1955 | Caldwell | 383/907 |
| 3,113,715 | 12/1963 | Pangrac | 383/35 |
| 3,372,857 | 3/1968 | Brayla | 383/35 |
| 4,165,890 | 8/1979 | Leff | 40/661 |
| 4,187,628 | 2/1980 | Thompson | 40/661 |
| 4,215,497 | 8/1980 | Levy | 40/661 |
| 4,721,064 | 1/1988 | Denk et al. | 40/301 |
| 4,784,864 | 11/1988 | Ikeda | 383/907 |
| 5,429,393 | 7/1995 | Parlo | 40/300 |
| 5,845,424 | 12/1998 | Mitchell | 40/661 |

FOREIGN PATENT DOCUMENTS

| | | | |
|---|---|---|---|
| 1369158 | 6/1964 | France | 383/35 |
| 183216 | 3/1936 | Switzerland | 383/35 |

*Primary Examiner*—Stephen P. Garbe
*Attorney, Agent, or Firm*—Michael I. Kroll

[57] ABSTRACT

A protective tag holder for receiving, protecting and retaining a tag in its original condition. The protective tag holder includes a first piece of material having an edge extending therearound, the edge forming a shape substantially matching a shape of the tag to be protected and a second piece of material having an edge extending therearound, the edge forming a shape substantially similar to the shape of the first piece of material. The second piece of material also includes a tab extending from at least a portion of the edge. A seal is formed between at least a portion of the edge of the first piece of material and the edge of the second piece of material forming a pocket therebetween. The seal extends around a portion of the edge of the second piece of material opposite the tab to thereby form an entrance to the pocket, the entrance having a size large enough to insert the tag therethrough. The protective tag holder is formed to have any desired size and shape to match the size and shape of a tag to be protected. The first and second pieces of material may also be tinted to any desired color for added protection from light and ultraviolet rays from the sun or be clear to provide an unobstructed view of the tag.

2 Claims, 6 Drawing Sheets

TRANSPARENT PROTECTIVE COLLECTIBLE TAG HOLDER

CROSS-REFERENCE TO RELATED APPLICATION

This application is a continuation-in-part of my application Ser. No. 29/075,575, filed Aug. 21, 1997, now U.S. Pat. No. D407,444 entitled "Swing Tag Protector for Stuffed Animals", which is incorporated herein by this reference.

BACKGROUND OF THE INVENTION

1. Field of the Invention

The present invention relates generally to label and tag holders and, more specifically, to a transparent plastic tag protector conforming substantially to a shape and size of the label or tag to be protected thereby preserving, protecting and retaining the tag in its original condition as provided by the manufacturer.

2. Description of the Prior Art

Many people throughout the world collect items such as stuffed animals and figurines. Such items normally come with tags identifying the object, the origin of the item and sometimes provide a history of the item or a story about the item. Not only is it desirable for the owner to protect the condition of the item but also the condition of the tags attached to the item. The value of the item has a direct relationship with the condition of the item and the condition of the tags attached to the item.

Over time dust, dirt and oils will collect on the item and tags causing the condition of the item and tags to deteriorate. Furthermore, through handling of the items and tags, the tags will become worn and may develop creases due to negligent handling thereof. In order to prevent this deterioration of the tags and the corresponding decrease in value the owner must take precautions to preserve and protect the item and tags.

Prior art methods of protecting and preserving the tags include laminating the tags. However, laminating the tags is an irreversible process which changes the quality of the tag from its original condition and thereby decreases the value of the entire item. Another method of protecting the tags involves placing the tags in a plastic covering. However, these plastic coverings were not adequately sized to cover the tag and thus did not adequately protect the tag.

It is thus desirable to provide a protective tag holder which is of a substantially identical size and shape to the size and shape of the tag. It is also desirable to provide a protective tag holder which is able to prevent dust, dirt and oils from contacting the tag. It is still further desirable to provide a protective tag holder which does not alter the condition of the tag. It is even still further desirable to provide a protective tag holder which can protect the tag from discoloration caused by ultraviolet radiation such as is caused by being exposed to the sunlight.

SUMMARY OF THE PRESENT INVENTION

The present invention relates generally to label and tag holders and, more specifically, to a transparent plastic tag protector conforming substantially to a shape and size of the label or tag to be protected thereby preserving, protecting and retaining the tag in its original condition as provided by the manufacturer.

A primary object of the present invention is to provide a protective tag holder that will overcome the shortcomings of prior art devices.

Another object of the present invention is to provide a protective tag holder which is able to protect and preserve the condition of a tag attached to an item of value.

A further object of the present invention is to provide a protective tag holder which is able to aid in retaining the original condition and characteristics of the tag throughout its lifetime.

A yet further object of the present invention is to provide a protective tag holder wherein the holder is designed to be substantially identical in size and shape to the size and shape of the tag.

A still further object of the present invention is to provide a protective tag holder which forms a pocket to receive the tag therein.

A further object of the present invention is to provide a protective tag holder wherein the pocket forms a snug and airtight container for the tag thereby protecting the tag from the elements.

A further object of the present invention is to provide a protective tag holder which is provided in any of a number of colors to provide a desired tint to the image of the tag while also providing a desired level of protection from light.

Another object of the present invention is to provide a protective tag holder that is simple and easy to use.

A still further object of the present invention is to provide a protective tag holder that is economical in cost to manufacture.

Additional objects of the present invention will appear as the description proceeds.

A protective tag holder for receiving, protecting and retaining a tag in its original condition is disclosed by the present invention. The protective tag holder includes a first piece of material having an edge extending therearound, the edge forming a shape substantially matching a shape of the tag to be protected and a second piece of material having an edge extending therearound, the edge forming a shape substantially similar to the shape of the first piece of material. The second piece of material also includes a tab extending from at least a portion of the edge. A seal is formed between at least a portion of the edge of the first piece of material and the edge of the second piece of material forming a pocket therebetween. The seal extends around a portion of the edge of the second piece of material opposite the tab to thereby form an entrance to the pocket, the entrance having a size large enough to insert the tag therethrough. The protective tag holder is formed to have any desired size and shape to match the size and shape of a tag to be protected. The first and second pieces of material may also be tinted to any desired color for added protection from light and ultraviolet rays from the sun or be clear to provide an unobstructed view of the tag.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

DESCRIPTION OF THE REFERENCED NUMERALS

Figure 1:
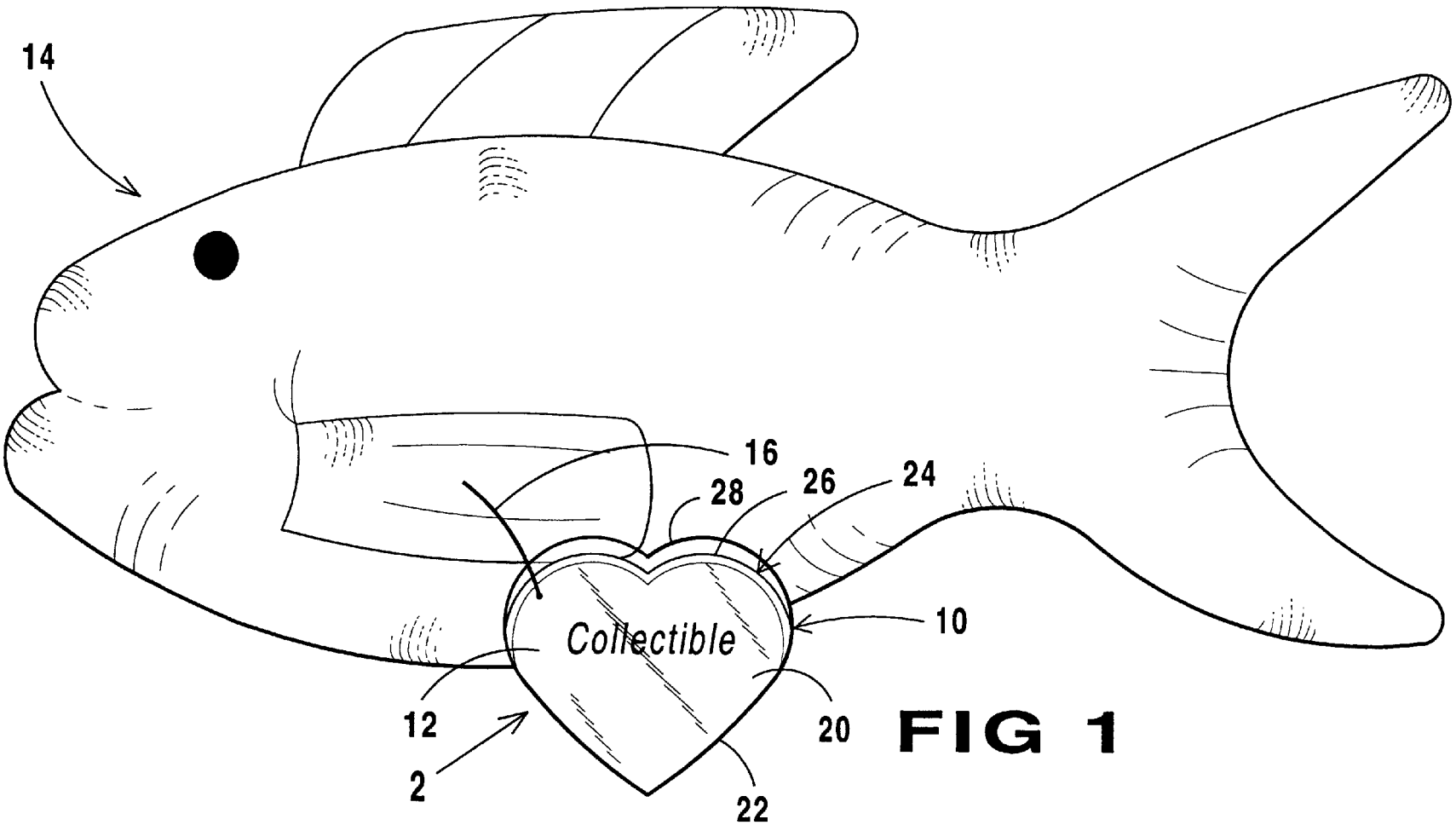
FIG. 1 is a side view of a stuffed animal having a tag positioned within the protective tag holder of the present invention.

Turning now descriptively to the drawings, in which similar reference characters denote similar elements throughout the several views, the Figures illustrate the protective tag holder of the present invention. With regard to the reference numerals used, the following numbering is used throughout the various drawing figures.

10 protective tag holder of the present invention
12 tag to be positioned within the protective tag holder
14 stuffed animal
16 string connecting tag to stuffed animal
18 back side
20 front side
22 seal
24 pocket
26 entrance to pocket
28 tab formed by enlarged portion of back side
30 arrows indicating direction in which tag is moved into protective tag holder
32 recess in back side for receiving string
34 cut out section in front side
36 oval shaped tag
38 back side of oval shaped protective tag holder
40 tab on oval shaped protective tag holder
42 entrance of oval shaped protective tag holder
44 front side of oval shaped protective tag holder
46 seal between back and front sides of oval shaped protective tag holder
48 pocket of oval shaped protective tag holder
50 arrow indicating direction of insertion of oval shaped tag
52 front side of square shaped protective tag holder
54 back side of square shaped protective tag holder
56 tab extending from back side of square shaped protective tag holder
58 seal connecting back and front sides of square shaped protective tag holder
60 entrance of square shaped protective tag holder
62 front side of star shaped protective tag holder
64 back side of star shaped protective tag holder
66 tab extending from back side of star shaped protective tag holder
68 seal connecting back and front sides of star shaped protective tag holder
70 entrance of star shaped protective tag holder
72 front side of octagon shaped protective tag holder
74 back side of octagon shaped protective tag holder
76 tab extending from back side of octagon shaped protective tag holder
78 seal connecting back and front sides of octagon shaped protective tag holder
80 entrance of octagon shaped protective tag holder
82 front side of circular shaped protective tag holder
84 back side of circular shaped protective tag holder
86 tab extending from back side of circular shaped protective tag holder
88 seal connecting back and front sides of circular shaped protective tag holder
90 entrance of circular shaped protective tag holder
92 front side of triangular shaped protective tag holder
94 back side of triangular shaped protective tag holder
96 tab extending from back side of triangular shaped protective tag holder
98 seal connecting back and front sides of triangular shaped protective tag holder
100 entrance of triangular shaped protective tag holder
102 front side of rectangular shaped protective tag holder
104 back side of rectangular shaped protective tag holder
106 tab extending from back side of rectangular shaped protective tag holder
108 seal connecting back and front sides of rectangular shaped protective tag holder
110 entrance of rectangular shaped protective tag holder

DETAILED DESCRIPTION OF THE PREFERRED EMBODIMENT

Turning now descriptively to the drawings, in which similar reference characters denote similar elements throughout the several views, FIGS. 1 through 11A illustrate the protective tag holder of the present invention indicated generally by the numeral 10.

The protective tag holder 10 is illustrated in FIG. 1 protecting a tag 12 attached to a stuffed animal 14 by a string 16. The protective tag holder 10 includes a back side 18 and a front side 20. A seal 22 such as a heat seal is formed connecting the edges of the back and front sides 18 and 20, respectively, producing a pocket 24 therebetween. The seal 22 extends along a portion of the edges and not along the entire edge thereby leaving open an entrance 26 to the pocket 24. The tag 12 is inserted into the pocket 24 through the entrance 26 and the string 16 connecting the tag 12 to the item 14 is positioned to extend through the entrance 26 and out of the pocket 24.

While a preferred structure for the seal 22 is shown and described herein, those of ordinary skill in the art who have read this description will appreciate that there are numerous other structures for the seal 22 and, therefore, as used herein the phrase "means for securing at least a portion of the edge of the first piece of material to the edge of the second piece of material" should be construed as including all such structures as long as they achieve the desired result of securing at least a portion of the edge of the first piece of material to the edge of the second piece of material, and therefore, that all such alternative mechanisms are to be considered as equivalent to the one described herein.

The back side 18 and front side 20 are substantially the same in size and shape. The back side 18 includes a tab 28 extending across the entrance 26 for use in separating the back side 18 from the front side 20 to thereby assist the user when placing the tag 12 into the pocket 24. Furthermore, the back side 18 and the front side 20 are also substantially identical in size and shape to that of the tag 12 to be protected.

Figure 2:
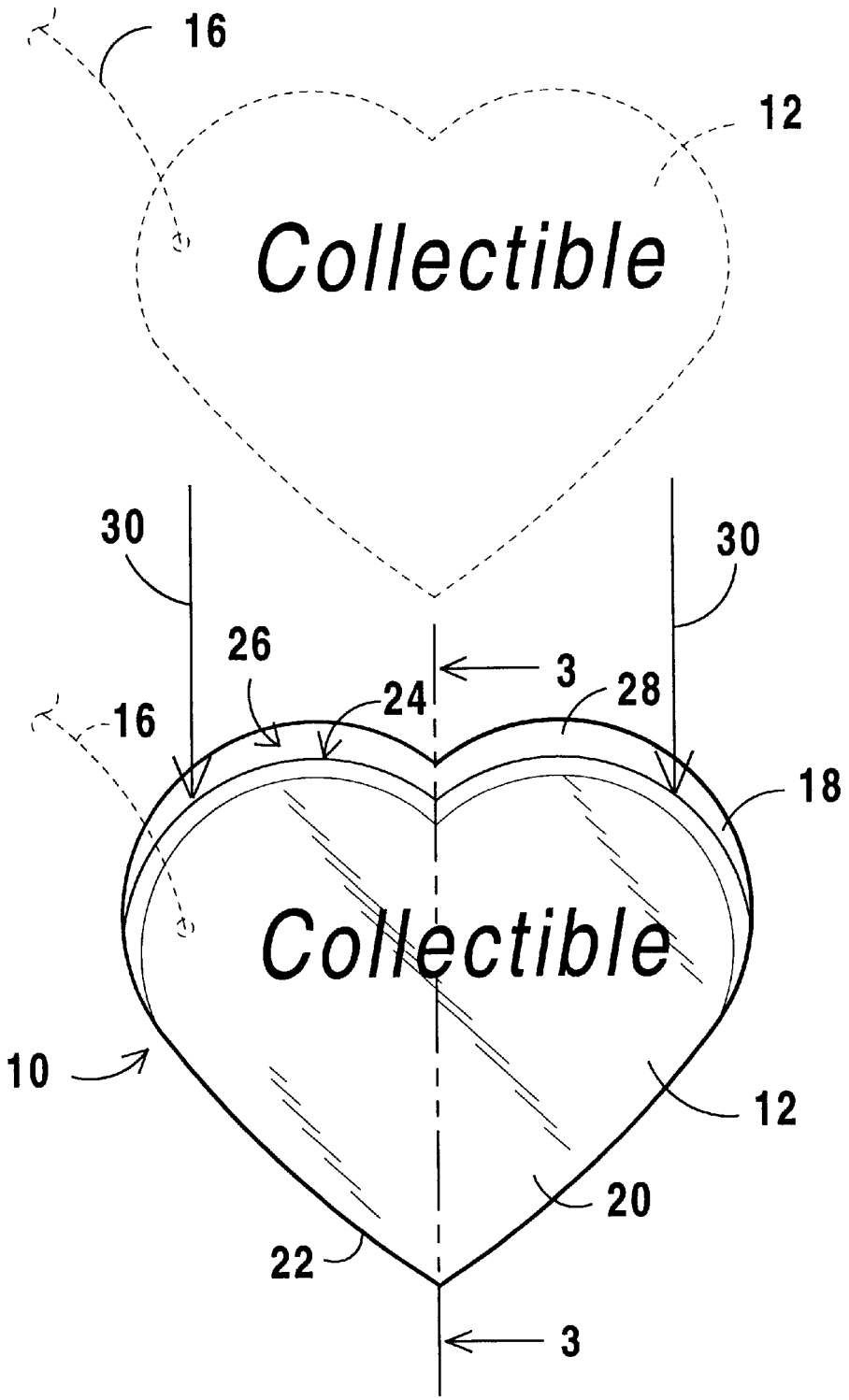
FIG. 2 is a front view of the protective tag holder of the present invention including a tag positioned therein, the tag is also illustrated in dashed lines showing placement of the tag within the protective tag holder.

The manner in which the tag 12 is placed into the pocket 24 is illustrated in FIG. 2. The tag 12 is illustrated in dashed lines with the string attached thereto. The tag 12 is inserted through the entrance 26 and into the pocket 24 formed between the back side 18 and front side 20 in the direction of the arrows labeled 30. The tag 12 is inserted into the pocket 24 and against the seal 22 connecting the back side 18 to the front side 20. As the protective tag holder 10 has a size and shape substantially identical to that of the tag 12, the tag 12 will be completely contained within the pocket 24 with the string 16 extending through the entrance 26 and out of the pocket 24. The tab 28 extends above the pocket 24 for aiding the user in opening the entrance 26 for insertion and removal of the tag 12 from the pocket 24.

Figure 3:
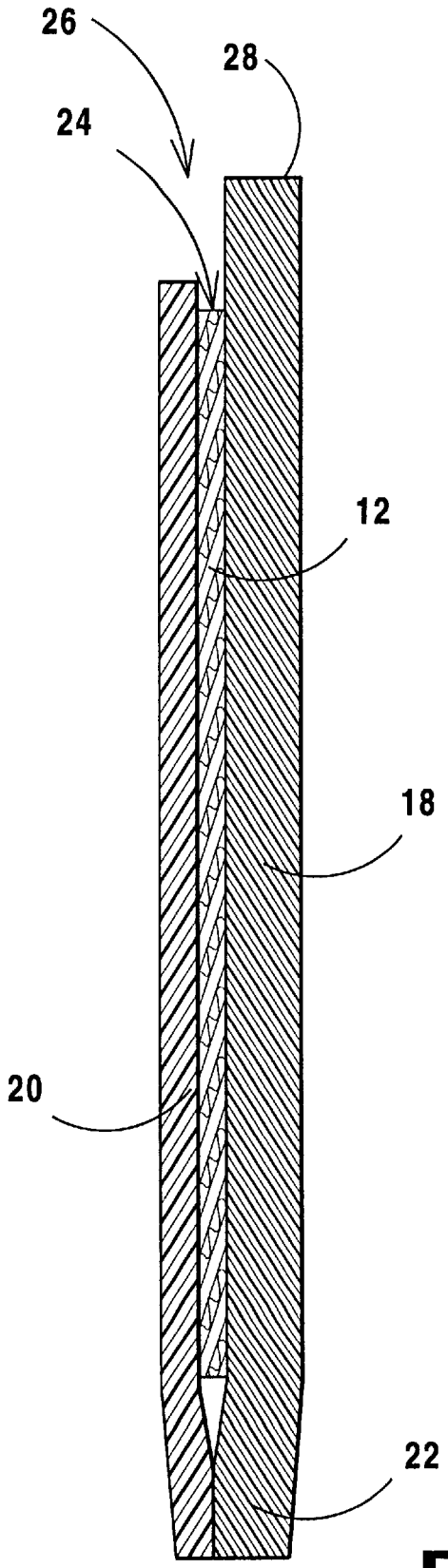
FIG. 3 is a side cross-sectional view of the view of the protective tag holder of the present invention.

A cross-sectional view of the protective tag holder 10 and a tag 12 inserted therein is illustrated in FIG. 3. This view is taken along the line 3—3 of FIG. 2. This view illustrates the back side connected to the front side 20 by the seal 22. The seal 22 is positioned about the edge of both the back side 18 and the front side 20 opposite the entrance 26. The extent to which the seal 22 extends around the edges depends upon the shape of the back side 18, front side 20 and the tag 12 to be positioned therebetween. The tag 12 is illustrated as being positioned within the pocket 24 and entirely between the back side 18 and the front side 20. The tab 28 extending from the edge of the back side 18 extends above the pocket 24 and provides an aid for opening the entrance 26 in order to insert and remove the tag 12 from the pocket 24.

Figure 4:
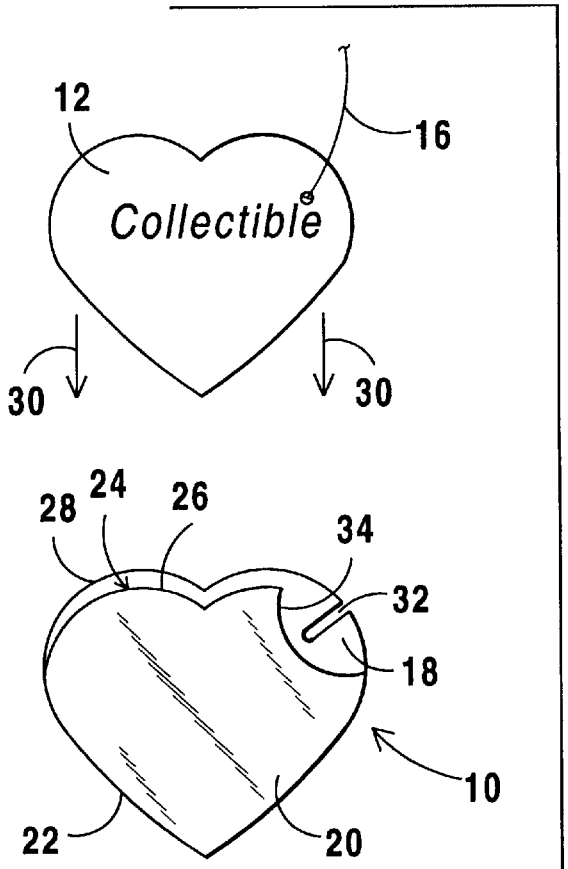
FIG. 4 is a front view of the protective tag holder of the present invention having an opening on a top side thereof for insertion of a tag to be protected thereby.

FIG. 4 shows insertion of a heart shaped tag 12 into the protective tag holder 10 of the present invention. As can be seen from this figure, the back side 18 has a size and shape substantially the same as the tag 12. The back side 18 also includes a tab 28 extending beyond the entrance 26. A recess 32 extends from a side of the tab 28 and towards the entrance 26. The recess 32 accommodates the string 16 extending from the tag 12. The front side 20 also has a size and shape substantially the same as the tag 12. The front side 20 includes a cut out section 34 overlapping and providing access to the recess 32 in the back side 18. The tag 12 is inserted through the entrance 26 and into the pocket 24 by inserting the tag 12 in the direction of the arrows labeled 30. When inserted into the pocket 26, the string 16 is received by the recess 32 and therefore no pressure or pulling force is exerted on the string 16 during insertion, removal or while the tag 12 is positioned in the pocket 24.

Figure 5:
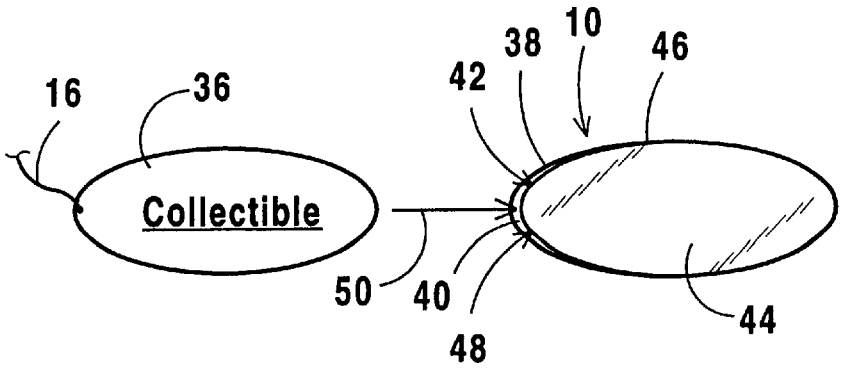
FIG. 5 is a front view of the protective tag holder of the present invention having an oval shape and an entry into the pocket on a side thereof for insertion of a tag to be protected thereby.

FIG. 5 shows insertion of an oval shaped tag 36 into the protective tag holder 10 of the present invention. As can be seen from this figure, the back side 38 has a size and shape substantially the same as the tag 36. The back side 38 also includes a tab 40 extending beyond the entrance 42. The front side 44 also has a size and shape substantially the same as the tag 36. The back side 38 is connected to the front side 44 by a seal 46 extending at least partially around the edges of the back and front sides 38 and 44, respectively. The seal 46 defines the size of the entrance 42 and assures that the entrance 42 is large enough for the tag 36 to pass therethrough and be received within the pocket 48 without degrading the condition of the tag 12. The tag 36 is inserted through the entrance 42 and into the pocket 24 by inserting the tag 12 in the direction of the arrow labeled 50.

Figure 6:
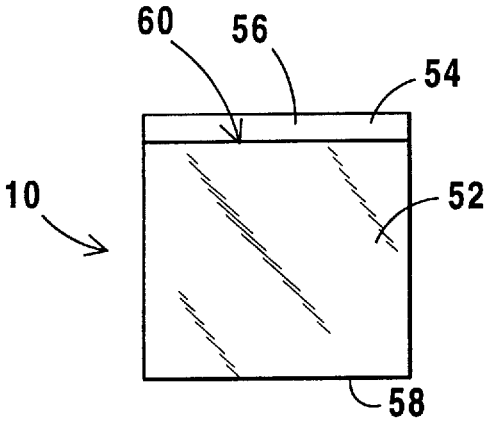
FIG. 6 is a front view of the protective tag holder of the present invention having a square shape.
Figure 6A:
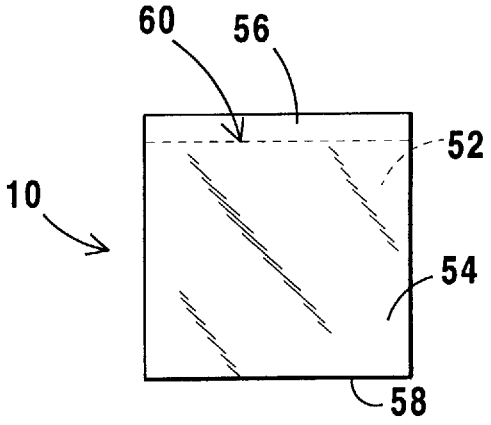
FIG. 6A is a back view of the protective tag holder of the present invention having a square shape.

FIGS. 6 and 6A illustrate a square shaped protective tag holder 10. A front view is illustrated in FIG. 6 and a back view is illustrated in FIG. 6A. As can be seen from these figures, the front side 52 is shaped as a square and the back side 54 is similarly shaped and includes the tab 56 extending from the back side 54. The seal 58 connects the edge along three sides of the front side 52 with the edge along three sides of the back side 54. The edge along the fourth side of the front and back sides 52 and 54, respectively, forms the entrance 60. The entrance 60 is formed along the edge of the back side 54 from which the tab 56 extends.

Figure 7:
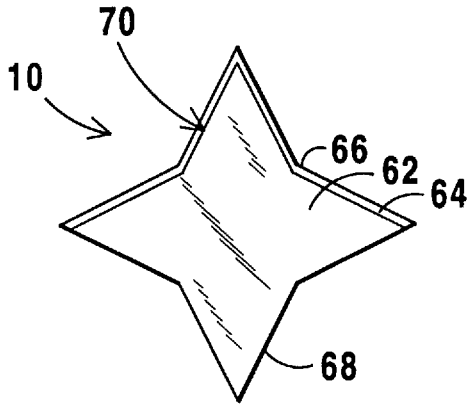
FIG. 7 is a front view of the protective tag holder of the present invention having a star shape.
Figure 7A:
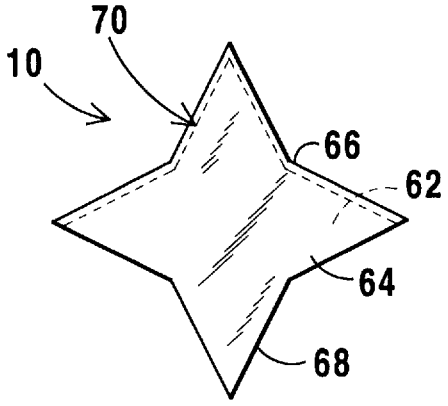
FIG. 7A is a back view of the protective tag holder of the present invention having a star shape.

FIGS. 7 and 7A illustrate a star shaped protective tag holder 10. A front view is illustrated in FIG. 7 and a back view is illustrated in FIG. 7A. As can be seen from these figures, the front side 62 is shaped as a star and the back side 64 is similarly shaped and includes the tab 66 extending from edge of half the sides of the back side 64. The seal 68 connects the edge along half of the sides of the front side 62 with the edge along half of the sides of the back side 64. The edge along the opposing half of the sides of the front and back sides 62 and 64, respectively, form the entrance 70. The entrance 70 is formed along the half of the sides of the back side 64 from which the tab 66 extends.

Figure 8:
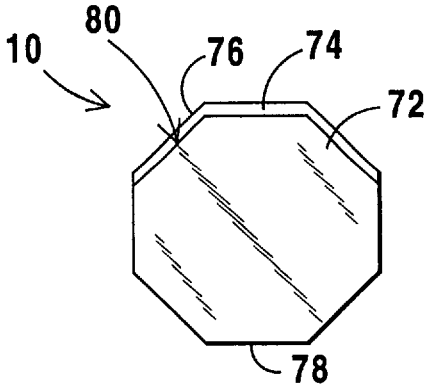
FIG. 8 is a front view of the protective tag holder of the present invention having an octagonal shape.
Figure 8A:
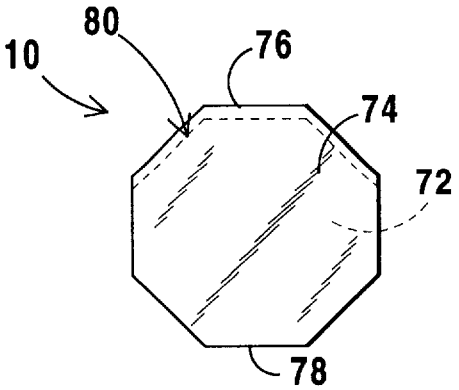
FIG. 8A is a back view of the protective tag holder of the present invention having an octagonal shape.

FIGS. 8 and 8A illustrate an octagon shaped protective tag holder 10. A front view is illustrated in FIG. 8 and a back view is illustrated in FIG. 8A. As can be seen from these figures, the front side 72 is shaped as an octagon and the back side 74 is similarly shaped and includes a tab 76 extending from an edge of three of the eight the sides of the back side 74. The seal 78 connects the edge along five sides of the front side 72 with the edge along five sides of the back side 74 not connected to the tab 76. The edge along the three sides of the front and back sides 72 and 74, respectively, not connected together by the seal 78 forms the entrance 80. The entrance 80 is formed along the three sides of the back side 74 from which the tab 76 extends.

Figure 9:
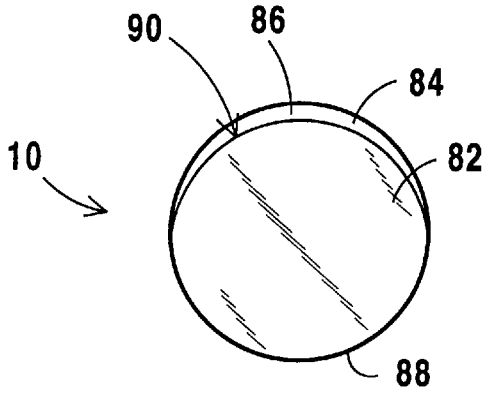
FIG. 9 is a front view of the protective tag holder of the present invention having a circular shape.
Figure 9A:
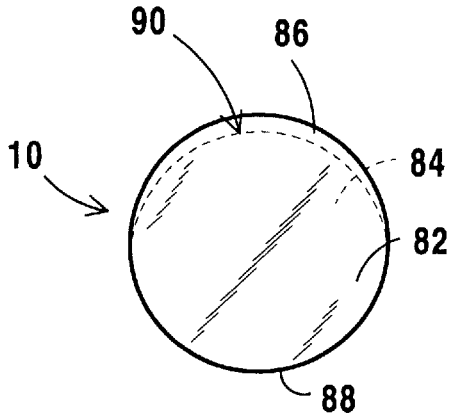
FIG. 9A is a back view of the protective tag holder of the present invention having a circular shape.

FIGS. 9 and 9A illustrate a circularly shaped protective tag holder 10. A front view is illustrated in FIG. 9 and a back view is illustrated in FIG. 9A. As can be seen from these figures, the front side 82 is shaped as a circle and the back side 84 is similarly shaped and includes the tab 86 extending from an edge of the back side 84 covering substantially half the circumference of the circle. The seal 88 connects the edge along substantially half the circumference of the front side 82 with the edge along substantially half the circumference of the back side 84. The edge along the opposing half the circumference of the front and back sides 82 and 84, respectively, forms the entrance 90. The entrance 90 is formed along the half of the circumference of the back side 84 from which the tab 86 extends.

Figure 10:
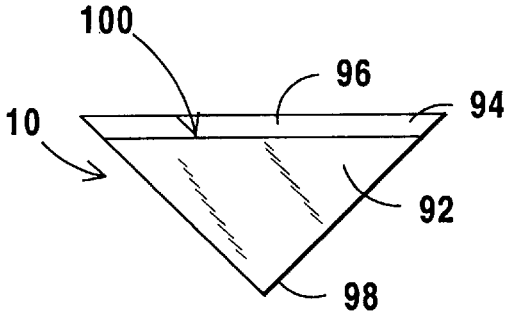
FIG. 10 is a front view of the protective tag holder of the present invention having a triangular shape.
Figure 10A:
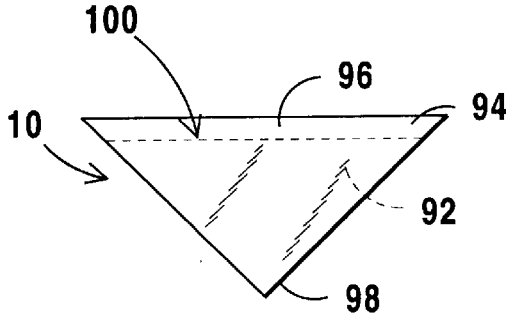
FIG. 10A is a back view of the protective tag holder of the present invention having a triangular shape.

FIGS. 10 and 10A illustrate a triangular shaped protective tag holder 10. A front view is illustrated in FIG. 10 and a back view is illustrated in FIG. 10A. As can be seen from these figures, the front side 92 is shaped as a triangle and the back side 94 is similarly shaped and includes the tab 96 extending from edge of the hypotenuse of the triangle shaped back side 94. The seal 98 connects the edge along the perpendicular sides of the front side 92 with the edge along the perpendicular sides of the back side 94. The edge along the hypotenuse of the front and back sides 92 and 94, respectively, forms the entrance 100. The entrance 100 is formed along the hypotenuse side of the back side 94.

Figure 11:
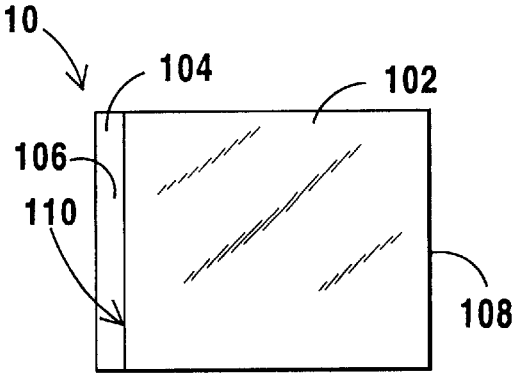
FIG. 11 is a front view of the protective tag holder of the present invention having a rectangular shape and an opening on a side thereof.
Figure 11A:
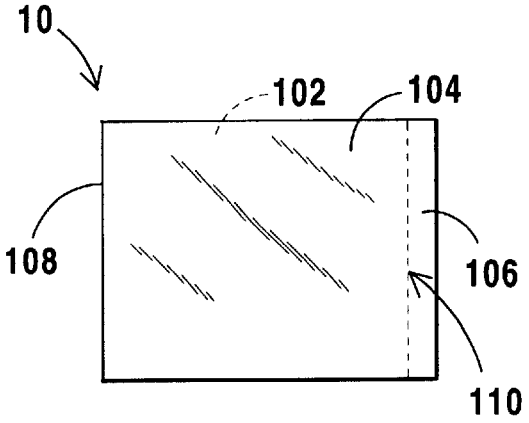
FIG. 11A is a back view of the protective tag holder of the present invention having a rectangular shape and an opening on a side thereof.

FIGS. 11 and 11A illustrate a rectangular shaped protective tag holder 10. A front view is illustrated in FIG. 11 and a back view is illustrated in FIG. 11A. As can be seen from these figures, the front side 102 is shaped as a rectangle and the back side 104 is similarly shaped and includes the tab 106 extending from one of the sides of the back side 104. The seal 108 connects the edge along three sides of the front side 102 with the edge along three sides of the back side 104. The edge along the other of the sides of the front and back sides 102 and 104, respectively, forms the entrance 110. The entrance 110 is formed along the side of the back side 104 from which the tab 106 extends.

The protective tag holder 10 may be made from any one of plastic, latex, any thermoplastic material and any combination thereof. The material forming the holder 10 must be flexible to aid in the insertion and removal of the tag 12 therefrom. The material forming the protective tag holder 10 may be clear or tinted to provide optimal protection of the tag from light. Furthermore, the material may have ultraviolet protection to protect any tag 12 therein from exposure to the ultraviolet rays found in sunlight.

The operation of the protective tag holder 10 will now be described with reference to the figures. In operation, the protective tag holder 10 is formed by shaping two pieces of material, the back and front sides 18 and 20, into a shape substantially the same of the tag 12 to be inserted therein. The back side 18 includes a tab 22 extending from at least a portion of the edge defining the shape of the back side 18.

A seal 22 is then formed connecting the back and front sides 18 and 20, respectively, and extends at least partially around the edges thereof to form a pocket 26 therebetween. The portion of the edges not connected together forms an entrance to the pocket 26 through which the tag 12 is inserted. A recess 32 may extend from an edge of the tab 28 and towards the entrance 26 to accommodate a string extending from the tag 12.

At this time the user will grasp the protective tag holder 10 and open the entrance by grabbing the tab 28 and gently pulling it away from the front side 20. The entrance 26 is now opened and the tag 12 to be protected is inserted into the pocket 24 through the entrance 26. The tag 12 is inserted until the edges of the tag 12 meet the seal 22 connecting the back and front sides 18 and 20. The tag 12 is now contained within the protective tag holder 10 and remains protected from the elements for as long as the tag 12 remains in the pocket 24.

From the above description it can be seen that the protective tag holder of the present invention is able to overcome the shortcomings of prior art devices by providing a protective tag holder which is able to protect and preserve the condition of a tag attached to an item of value while retaining the original condition and characteristics of the tag throughout its lifetime. The protective tag holder is designed to be substantially identical in size and shape to the size and shape of the tag, forming a pocket to receive the tag therein. The protective tag holder forms a snug and airtight container for the tag within the pocket thereby protecting the tag from the elements. The protective tag holder is also provided in any of a number of colors to provide a desired tint to the image of the tag. Furthermore, the protective tag holder of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by letters Patent is set forth in the appended claims:

1. A protective tag holder for receiving, protecting and retaining a tag in its original condition, said protective tag holder comprising:

a) a first piece of material having an edge extending therearound, said edge defining a shape and size substantially similar to a shape and size of the tag to be protected;

b) a second piece of material having an edge extending therearound, said edge defining a shape and size substantially similar to said shape and size of said first piece of material;

c) means comprising a heat seal for securing the edge of said first piece of material to the edge of said second piece of material forming a pocket between said first and second pieces of material, said securing means leaving an opening to form an entrance to said pocket, said pocket having a size large enough to insert the tag therethrough, said second piece of material extending beyond said entrance forming a tab to provide an aid for opening said entrance;

d) said first and second pieces of material providing protection from ultra violet rays emanating from the sun; and e) a string having one end thereof attached to and adjacent an edge of said tag, the other end of said string being unattached to said tag holder;

f) said second piece of material having a recess extending inwardly toward said opening from an edge of said second piece of material adapted to accommodate said string when said tag is inserted into said holder; and g) said first piece of material having a curved cut out section fully exposing said recess.

2. The protective tag holder as recited in claim 1, wherein said first and second pieces of material are formed of a semi-flexible material.

* * * * *